US006398595B2

(12) United States Patent
Wakata et al.

(10) Patent No.: US 6,398,595 B2
(45) Date of Patent: Jun. 4, 2002

(54) CONSTRUCTION FOR PREVENTING ERRONEOUS ASSEMBLING OF BATTERY TERMINALS, A BATTERY AND A SET OF TERMINALS

(75) Inventors: Shigekazu Wakata; Hideki Matsunaga, both of Yokkaichi; Keiichi Itou, Aichi-ken; Kazuyuki Shiraki, Aichi-ken; Masanori Wakui, Aichi-ken, all of (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/801,247

(22) Filed: Mar. 7, 2001

(30) Foreign Application Priority Data

Mar. 22, 2000 (JP) ..... 2000-080121
Mar. 27, 2000 (JP) ..... 2000-062439

(51) Int. Cl.[7] ..... H01R 4/30

(52) U.S. Cl. ..... 439/755; 429/1; 439/766; 439/883

(58) Field of Search ..... 439/755, 766, 439/883, 801, 771, 756, 522, 907, 287; 429/1, 121

(56) References Cited

U.S. PATENT DOCUMENTS

| | | | | |
|---|---|---|---|---|
| 3,980,388 A | | 9/1976 | Nailor, III | 439/752 |
| 4,064,328 A | | 12/1977 | Allen | 429/121 |
| 4,226,497 A | * | 10/1980 | Polonsky et al. | 429/1 |
| 4,572,878 A | * | 2/1986 | Daugherty | 439/522 |
| 4,693,948 A | * | 9/1987 | McEwan | 429/121 |
| 5,167,529 A | * | 12/1992 | Verge | 429/1 |
| 5,413,500 A | | 5/1995 | Tanaka | 439/521 |
| 5,672,442 A | | 9/1997 | Burnett | 429/121 |
| 5,711,688 A | | 1/1998 | Matsunaga et al. | 439/762 |

FOREIGN PATENT DOCUMENTS

| | | |
|---|---|---|
| DE | 2 028 012 | 12/1971 |
| EP | 0 349 473 | 1/1990 |
| GB | 700131 | 11/1953 |

* cited by examiner

*Primary Examiner*—Brian Sircus
*Assistant Examiner*—Javaid Nasri
(74) *Attorney, Agent, or Firm*—Anthony J. Casella; Gerald E. Hespos

(57) ABSTRACT

A battery (B) includes electrodes (11*a,* 11*b*) and engaging portions (10*a,* 10*b*) formed by recessing portions of the battery (B) around the electrodes (11*a,* 11*b*), and recesses (14*a,* 14*b,* 23*a,* 23*b*) are formed in side surfaces of the engaging portions (10*a,* 10*b*). The recesses (14*a,* 14*b,* 23*a,* 23*b*) are symmetrically arranged in the left and right engaging portions (10*a,* 10*b*). Transversely symmetrical identification pieces (19*a,* 19*b*) project from the leading ends of terminals (15*a,* 15*b*). In the case of a correct correspondence of the electrodes (11*a,* 11*b*) and the terminals (15*a,* 15*b*), the identification pieces (19*a,* 19*b*) fit into the recesses (14*a,* 14*b,* 23*a,* 23*b*), enabling assembling of the terminals (15*a,* 15*b*) with the electrodes (11*a,* 11*b*). In the case of an incorrect correspondence, the identification pieces (19*a,* 19*b*) cannot be fitted into the recesses (14*a,* 14*b,* 23*a,* 23*b*) and interfere with the upper surface of the battery (B), making assembling impossible.

4 Claims, 20 Drawing Sheets

CONSTRUCTION FOR PREVENTING ERRONEOUS ASSEMBLING OF BATTERY TERMINALS, A BATTERY AND A SET OF TERMINALS

BACKGROUND OF THE INVENTION

1. Field of the Invention

The present invention relates to a construction for preventing erroneous assembling of battery terminals. The invention also relates to a battery and to a set of terminals for connection with the battery.

2. Description of the Related Art

Shafts project from the upper surface of an automotive battery as a (+)-electrode and a (−)-electrode. The shafts can be inserted into round holes of terminals connected with a battery cord and the terminals can be fastened to the shafts with nuts or the like.

However, the battery terminals are substantially identical, and hence are connectable with either one of the electrodes. Accordingly, the battery terminals may be connected with incorrect electrodes.

The present invention was developed in view of the above situation and an object of the invention is to provide a construction capable of preventing erroneous assembling of battery terminals. Another object of the invention is to provide a battery and a set of terminals for connection therewith.

SUMMARY OF THE INVENTION

The invention is directed to a construction for preventing erroneous assembling of battery terminals, and hence for correctly assembling the terminals with a corresponding (−)-electrode and (+)-electrode of a battery. The two terminals and the two electrodes comprise identification means for enabling assembling only if a correct correspondence exists between the terminals and the electrodes, while preventing assembly of the terminals with the electrodes if there is incorrect correspondence.

The identification means may comprise identification pieces symmetrically formed on both terminals, and transversely symmetrical engaging portions formed near the electrodes of the battery. The identification pieces can be fit on or inserted in the engaging portions of the electrodes. Thus, an attempt to connect the terminals with the wrong electrodes will produce interference between the identification pieces and the engaging portions and will prevent the terminals and electrodes from being assembled. However, terminals and electrodes that correspond correctly can be connected because the identification pieces can be fit on or inserted in the engaging portions. Additionally, the identification means on the battery can be distinguished easily in appearance from electrodes of existing standards.

The identification means of the electrodes may comprise a threaded shaft on one electrode and a nut in the other electrode. The identification means of the terminals comprises a nut in the terminal that corresponds to the electrode with the threaded shaft, and hence that terminal can be screwed down on the threaded shaft. Conversely, a threaded shaft is provided in the terminal that corresponds to the electrode with the nut. Hence that terminal can be engaged with the nut of the corresponding electrode. Accordingly, an incorrect correspondence between terminals and electrodes, results in a combination of the threaded shafts or a combination of nuts. Thus, the terminals and the electrodes cannot be assembled.

The identification means of the electrodes also may comprise threaded shafts of different diameters and a key-receiving portion formed around or near the electrode with the thicker threaded shaft. The identification means of the terminals may comprise insertion holes having different diameters for enabling insertion of the threaded shafts. A key may be formed on the terminal with the larger insertion hole and may be fit in a key-receiving portion. The terminal with the smaller insertion hole cannot be assembled with the electrode that has the thicker threaded shaft. The terminal with the larger insertion hole theoretically can be assembled with the electrode that has the thinner threaded shaft. However, the key interferes with part of the battery. Accordingly, insertion of the thinner threaded shaft into the larger insertion hole is impossible. The correct terminals can be assembled with the electrodes because the key fits into the key-receiving portion.

The identification means of the terminals also may comprise a cover that is mounted on or over the terminal. The identification means of the electrodes may comprise a terminal-accommodating portion for accommodating the terminal with the cover by conforming to the cover if a correct correspondence between the terminals and the electrodes exists. However, the identification means may make it impossible to connect the terminals with the incorrect electrodes by causing the cover to interfere with the battery. Accordingly, erroneous assembling of the terminal that has the cover with the wrong electrode can be avoided by the identification means of the electrode.

The electrodes may comprise engaging portions in the form of recesses around the threaded shafts of the electrodes and identification recesses formed in wall surfaces of the engaging portions. The terminals may comprise identification pieces that do not fit into the identification recess of the incorrect electrode and that are formed in different positions in the terminals. Accordingly, the identification recesses and the identification pieces interfere with each other to make assembling impossible in the case of the incorrect correspondence between the terminals and the electrodes.

Incorrect correspondence prevents complete assembly of the terminal with the electrode for each of the above-described embodiments. An operator can notice the incorrect correspondence and can make corrections.

The construction may further comprise rotation-preventing means for preventing rotation of the terminals with respect to the corresponding electrodes. The rotation preventing means prevents rotation during fastening and enables fastening to be performed smoothly. For example, the electrodes may have identification recesses and the terminals may have rotation preventing pieces that project in positions different from the identification pieces. The rotation preventing pieces fit into the identification recesses when there is correct correspondence between the terminals and the electrodes. This contact of the rotation preventing pieces with wall surfaces of the identification recesses prevents rotation of the entire terminals during fastening with the nuts.

The rotation preventing means may comprise the identification pieces. More particularly, the identification pieces may fit into the identification recesses when there is correct correspondence between the terminals and the electrodes to prevent rotation of the terminals relative to the electrodes. However, the identification pieces may be unable to fit into the identification recesses due to interference with the peripheries of the identification recesses when there is incorrect correspondence.

Contact pieces that can be brought into contact with wall surfaces of the identification recesses may be formed by bending edges of the identification pieces and/or the rotation preventing pieces forward with respect to the rotating directions of the terminals during fastening with the nuts. Thus, the contact area between the identification pieces and the identification recesses is increased and a rotation preventing function is enhanced.

A cover may be mounted on or over the terminal, and the identification piece and/or rotation preventing means of the terminal may project out of the cover. The projection of the identification piece from the cover prevents rotation and erroneous assembling regardless of whether the cover is mounted or not.

The invention also is directed to a battery having a (−)-electrode and a (+)-electrode. Corresponding terminals are connectable with the electrodes of the battery. The electrodes comprise identification means for enabling connection of terminals only in the case of a correct correspondence of the terminals and the electrodes. The identification means prevent assembly of the terminals with the electrode portions when there is incorrect correspondence.

Recesses may be formed around or near the electrodes and may have a depth so that the electrodes do not project to the upper surface of the battery. Accordingly, inadvertent contact of a tool or the like with the electrodes can be prevented.

The identification pieces may be formed symmetrically on both terminals, and/or the electrodes may be formed with symmetrical engaging portions in which the identification pieces may fit. Accordingly, the identification pieces and the engaging portions interfere with each other when there is incorrect correspondence, and connection of the terminals is impossible.

The invention also is directed to a set of terminals that are connectable at least with corresponding (−)-electrode and (+)-electrodes of a battery. The terminals comprise identification means for enabling connection of terminals only in the case of a correct correspondence of the terminals and the electrodes and prevent assembly of the terminals with the electrodes when there is incorrect correspondence.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
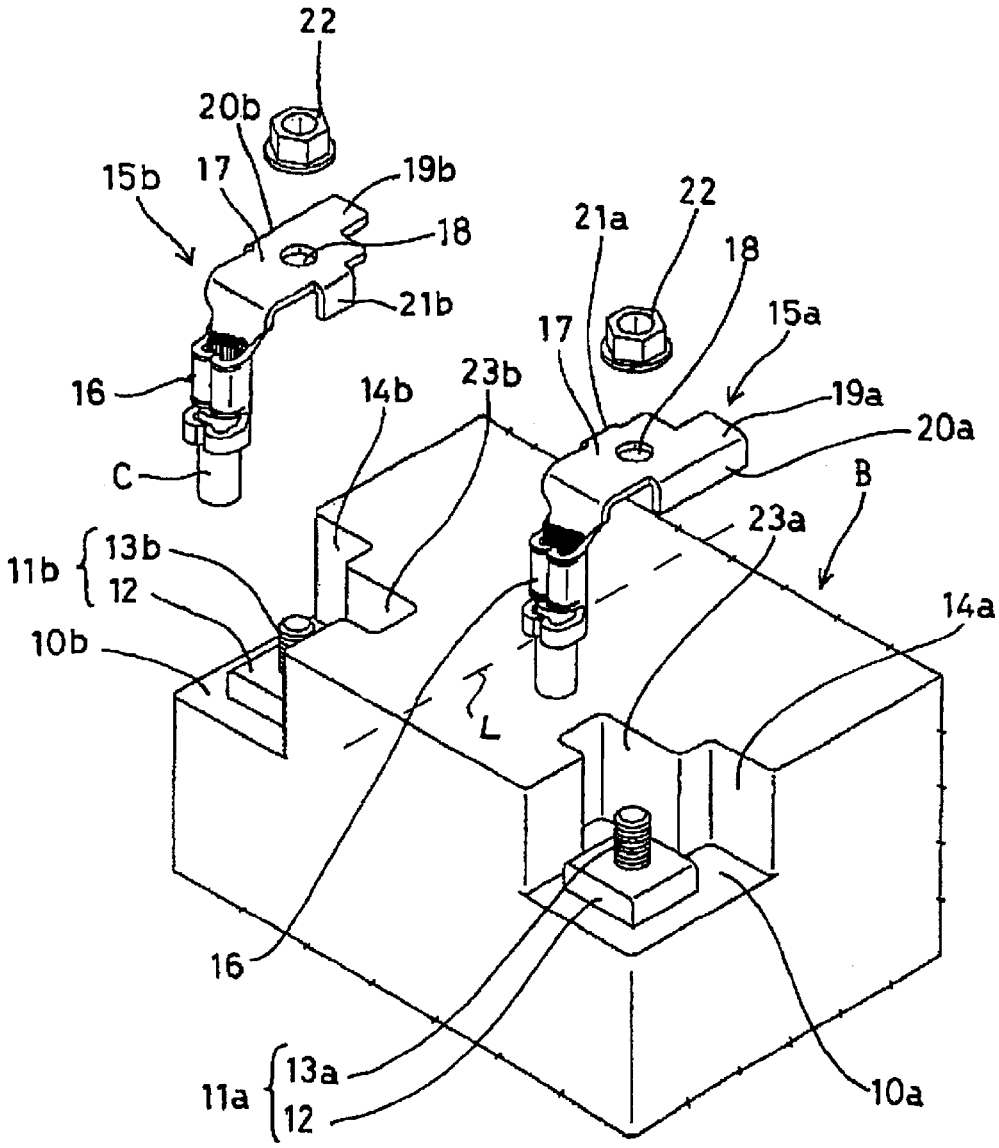
FIG. 1 is an exploded perspective view showing an assembling construction of a first embodiment.
Figure 2:
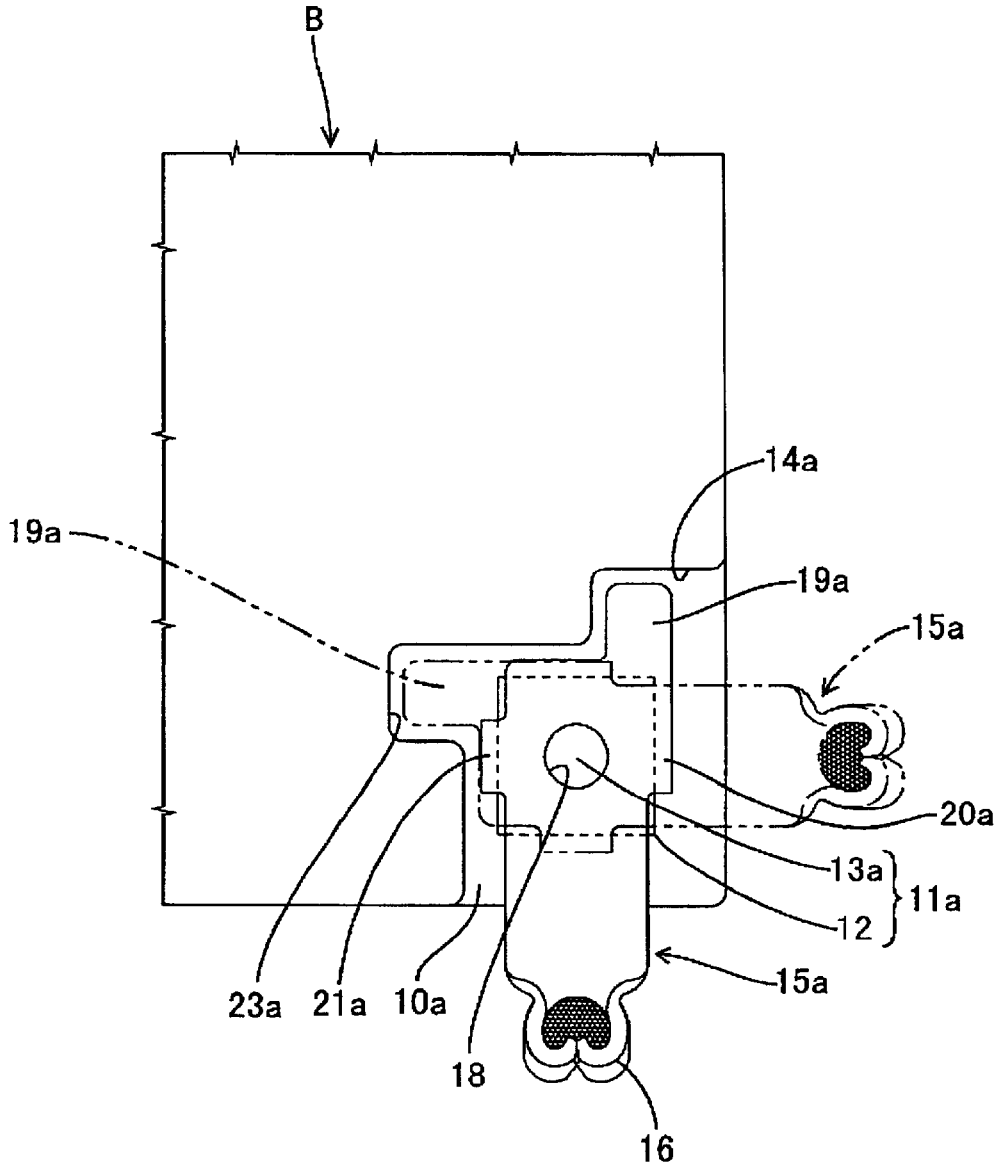
FIG. 2 is a plan view showing an assembled state of an engaging portion and a terminal.
Figure 3:
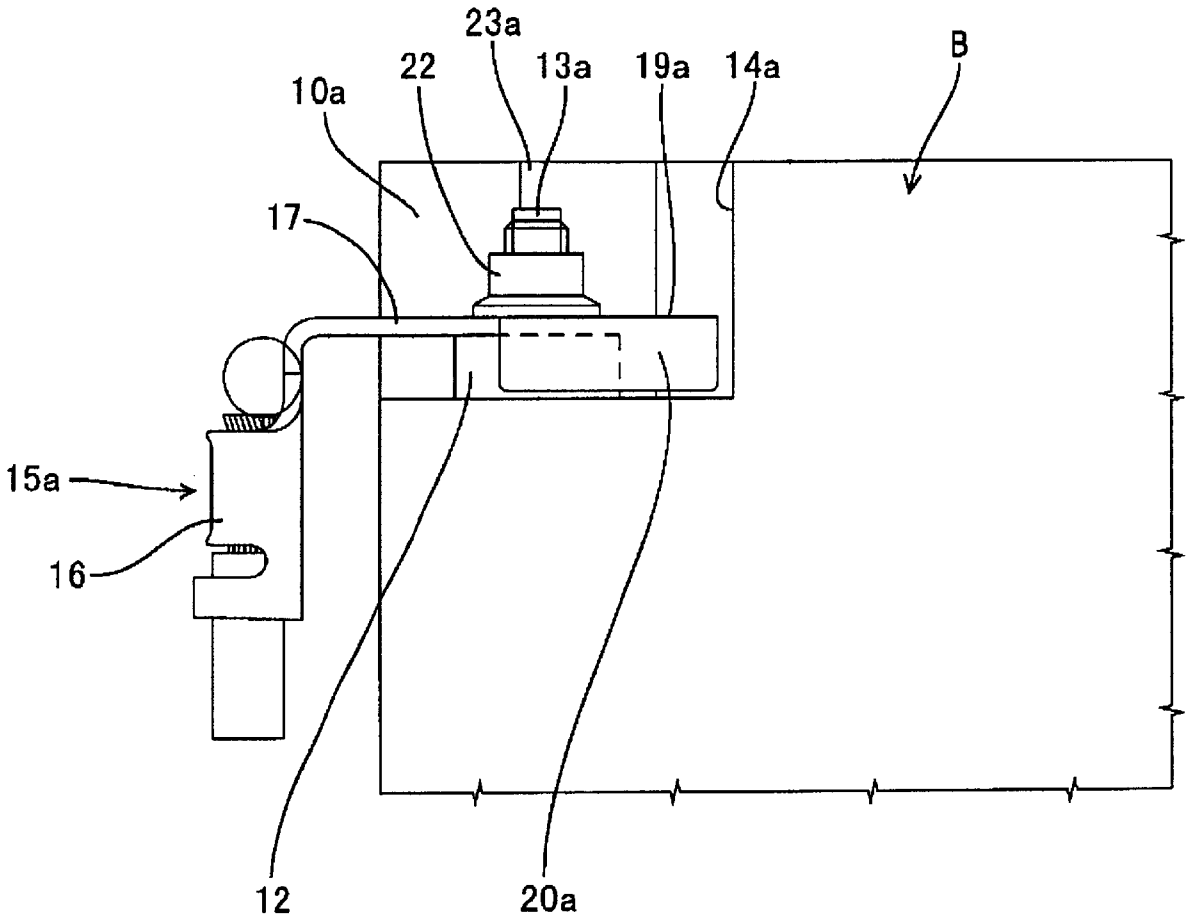
FIG. 3 is a side view showing the assembled state of the engaging portion and the terminal.

The letter B in FIGS. 1–3 identifies a battery in accordance with the invention. The illustrated battery B is e.g. a 36V-battery (usually 12V-battery). Left and right corners of the battery B are recessed to form engaging portions 10*a,* 10*b,* as shown in FIG. 1, and a (+)-electrode 11*a* and a (−)-electrode 11*b* are provided on the bottom surfaces of the engaging portions 10*a,* 10*b*. The electrodes 10*a,* 10*b* have threaded shafts 13*a,* 13*b* that project vertically or substantially normal from central positions on washers 12. The washers 12 shown in FIG. 1 are in the form of a square flat plates. The depth of the engaging portions 10*a,* 10*b* is set such that the threaded shafts 13*a,* 13*b* do not project to the upper surface of the battery B. Further, first and second recesses 14*a* and 23*a* are formed in two lateral walls of the engaging portion 10*a,* and similar recesses 14*b* and 23*b* are formed in two lateral walls of the engaging portion 10*b*. The corresponding recesses 14*a*, 23*a* and 14*b*, 23*b* of the engaging portions 10*a,* 10*b* are transversely symmetrical such that the recessing directions of the corresponding recesses 14*a*, 23*a* and 14*b*, 23*b* are substantially normal to each other, as shown in FIG. 2. The recesses 14*a* and 14*b* as well as 23*a* and 23*b* are preferably substantially symmetrical with respect to a line L that extends transversely between the electrodes 11*a,* 11*b*.

Terminals 15*a* and 15*b* are connectable with the electrodes 11*a* and 11*b* respectively. The terminals 15*a* and 15*b* are made of a conductive metallic material and each has a barrel 16 at its rear end for connection of a battery cord C, preferably by crimping. Base plates 17 are formed at front portions of the terminals 15*a*, 15*b* and are bent at an angle different from 0° or 180°, preferably substantially at a right angle to the barrels 16. Each base plate 17 is formed in its middle with an insertion hole 18 through which the threaded shaft 13*a,* 13*b* can be inserted. The base plates 17 of the left and right terminals 15*a*, 15*b* are formed to be transversely symmetrical or symmetrical with respect to the line L when fitted on the battery B. Specifically, identification pieces 19*a* and 19*b* project forward from the leading ends of the base plates 17 of the respective terminals 15*a*, and 15*b*. The identification pieces 19*a*, 19*b* have substantially half the width of the leading edge of the base plates 17, and can be fit into the first or second recesses 14*a*, 14*b*, 23*a*, 23*b* (see FIG. 2). The identification pieces 19*a*, 19*b* of the left and right terminals 15*a*, 15*b* also are formed to be transversely symmetrical or symmetrical with respect to the line L when fitted on the battery B. The identification pieces 19*a*, 19*b* interfere with the upper surface of the battery B to prevent the terminals 15*b*, 15*a* from being assembled with the incorrect electrodes 11*a*, 11*b*. However, if a correspondence between the terminals 15*a*, 15*b* and the electrodes 11*a*, 11*b* is correct, the identification pieces 19*a*, 19*b* fit into the first or second recesses 14*a*, 14*b*, 23*a*, 23*b*, enabling connection of the terminals 15*a*, 15*b* with the electrodes 11*a*, 11*b*. Thus, the identification pieces 19*a*, 19*b* and the recesses 14*a*, 14*b*, 23*a*, 23*b* define identification means.

Sides of the terminals 15*a*, 15 from the identification pieces 19*a*, 19*b* to the base plates 17 are bent down at an angle different from 0° or 180°, preferably substantially at right angles, to form first rotation preventing pieces 20*a*, 20*b*. Sides of the base plates 17 opposite the first rotation preventing pieces 20*a*, 20*b* also are bent down substantially at right angles, to form second rotation preventing pieces 21*a*, 21*b* that preferably have shorter lengths than the first rotation preventing pieces 20*a*, 20*b*. The washers 12 are held tightly by or interact with the first and second rotation preventing pieces 20*a*, 20*b*, 21*a* and 21*b*. As a result, rotation of the terminals 15*a*, 15*b* is prevented when nuts 22 are screwed down on the threaded shafts 13*a*, 13*b*.

The terminals 15*a* and 15*b* can be mounted onto the correct electrodes 11*a* and 11*b* so that the identification pieces 19*a* and 19*b* fit tightly into the first or second recesses 14*a*, 14*b*, 23*a* or 23*b*. The threaded shafts 13*a* and 13*b* then are inserted into the insertion holes, and the washers 12 are held tightly by or interact with the first and second rotation preventing pieces 20*a*, 20*b*, 21*a* and 21*b*. The nuts 22 then are screwed down on the threaded shafts 13*a*, 13*b* with the base plates 17 and the washers 12 held in close contact. Thus, rotation of the terminals 15*a*, 15*b* is prevented by the rotation preventing pieces 20*a*, 20*b*, 21*a*, 21*b*. In this way, connection of the terminals 15*a*, 15*b* with the correctly corresponding electrodes 11*a*, 11*b* is completed.

In the case of an incorrect correspondence between the terminals 15*a*, 15*b* and the electrodes 11*a*, 11*b*, the identification pieces 19*a*, 19*b* will not fit into either the first or second recesses 14*a*, 14*b*, 23*a* and 23*b* and interfere with the upper surface of the battery B. As a result, the terminals 15*a*, 15*b* cannot be assembled with the engaging portions 10*a*, 10*b*. Thus, an operator can immediately notice an incorrect arrangement of the terminals 15*a*, 15*b*.

As described above, erroneous assembling of the terminals 15*a*, 15*b* can be prevented by transversely symmetrically forming the identification pieces 19*a*, 19*b* and the recesses 14*a*, 14*b*, 23*a*, 23*b* in the first embodiment. Further, since the battery B according to this embodiment has a special form in which the engaging portions 10*a*, 10*b* are formed around the electrodes 11*a*, 11*b*, it contributes to distinction from conventional 12V-batteries. Furthermore, since the depth of the engaging portions 10*a*, 10*b* is set such that the threaded shafts 13*a*, 13*b* do not project to the upper surface of the battery B, inadvertent contact of a tool or the like with the threaded shafts is avoided.

Figure 4:
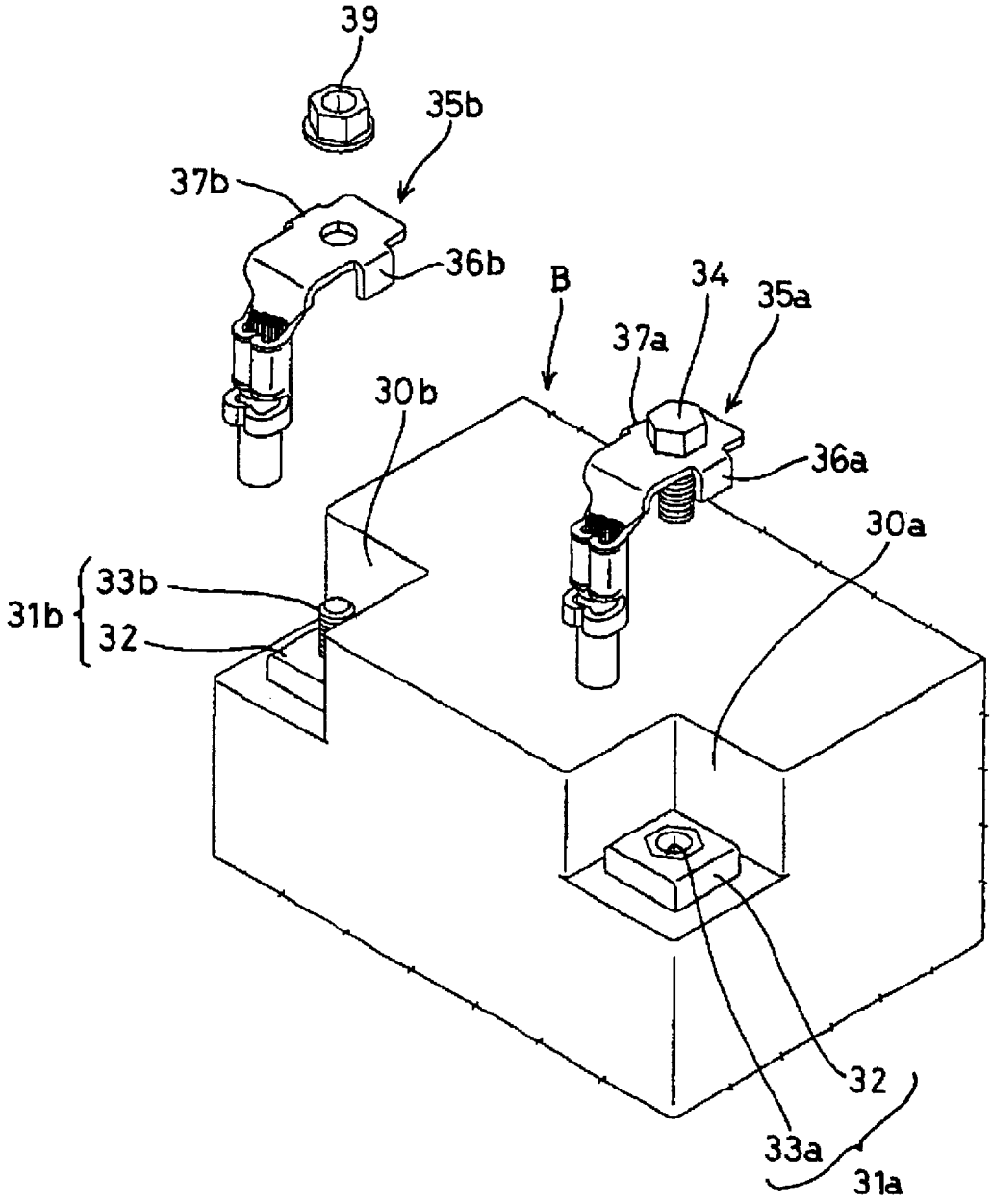
FIG. 4 is an exploded perspective view showing an assembling construction of a second embodiment.
Figure 5:
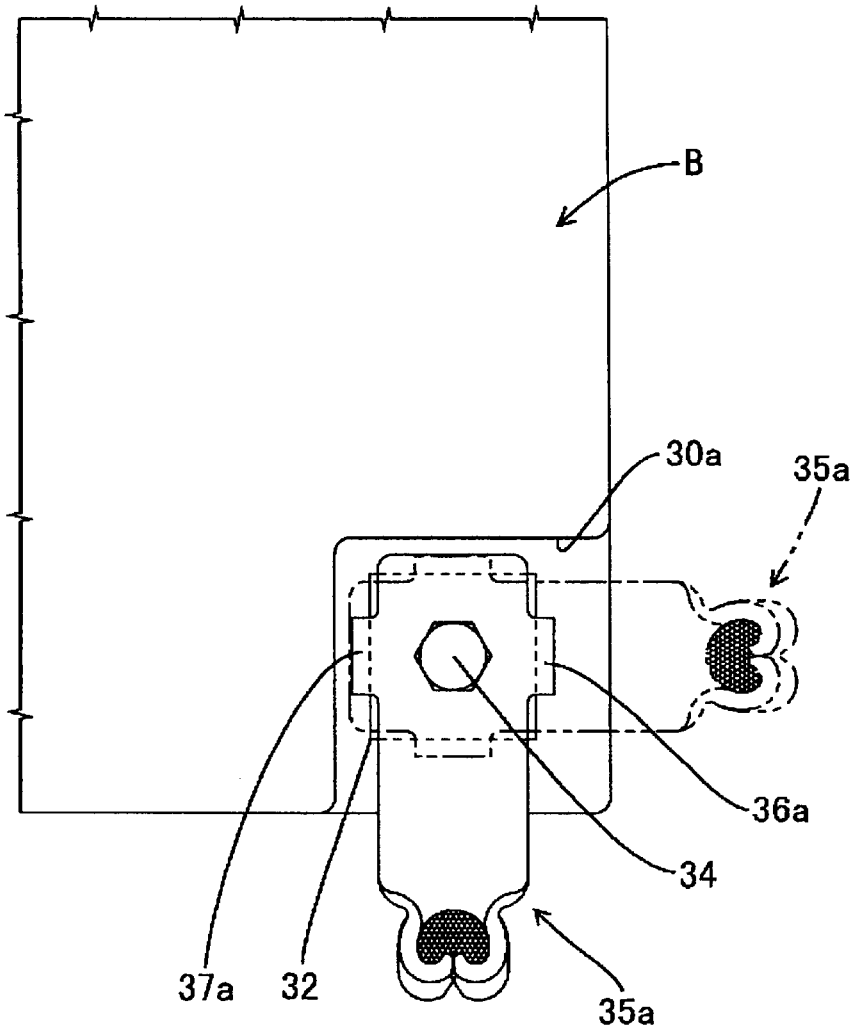
FIG. 5 is a plan view showing an assembled state of an engaging portion and a terminal.

The letter B in FIGS. 4 and 5 identifies a battery in accordance with a second embodiment of the invention. The battery B has a first electrode 31*b* with a threaded shaft similar to the electrodes of the first embodiment. However, the second electrode defines a nut 33*a* embedded in a washer 32. The electrodes 31*a*, 31*b* are in substantially rectangular recesses 30*a*, 30*b*, but without the recesses 14*a*, 14*b*, 23*a* and 23*b* of the first embodiment. Accordingly, the terminals 35*a* and 35*b* do not have identification pieces, but are formed with rotation preventing pieces 36*a*, 36*b* or 37*a*, 37*b* for tightly holding the washers 32. A bolt 34 is held rotatably on the terminal 35*a* by a temporary locking mechanism (not shown). The temporary locking mechanism may be a frangible weld between the lower surface of a head of the bolt 34 and a base plate of the terminal 35*a*. The weld may be sufficiently weak to break as the bolt 34 is screwed. The temporary locking mechanism also may be a claw at the edge of the insertion hole for softly engaging a thread of the bolt. Alternatively, the bolt 34 may be formed with a recess that engages the base plate of the terminal 35*a* to allow further rotation of the bolt 34 while longitudinally or axially holding the bolt 34 with respect to the base plate.

A nut 39 can be used to fasten the terminal 35*b* to the threaded shaft 33*a* of the electrode 31*b*, if there is correct correspondence between the terminals 35*a*, 35*b* and the electrodes 31*a*, 31*b*. Similarly, this correct correspondence enables the bolt 34 of the terminal 35 to be fastened to the nut 33*b* of the electrode 31*b*.

Incorrect correspondence between the terminals 35*a*, 35*b* and the electrodes 31*a*, 31*b* will align the bolt 34 of the terminal 35*a* with the threaded shaft 33*b* of the electrode 31*b*. Similarly, incorrect correspondence will align the terminal 35*b*, which should be fastened by the nut 39, with the embedded nut 33*a* of the electrode 31*a*. Connection is impossible with either combination, and an operator immediately knows the erroneous assembly.

The temporary locking mechanism in this embodiment couples the bolt 34 to the terminal 35*a*. However, the nut 39 also may be coupled temporarily.

Figure 6:
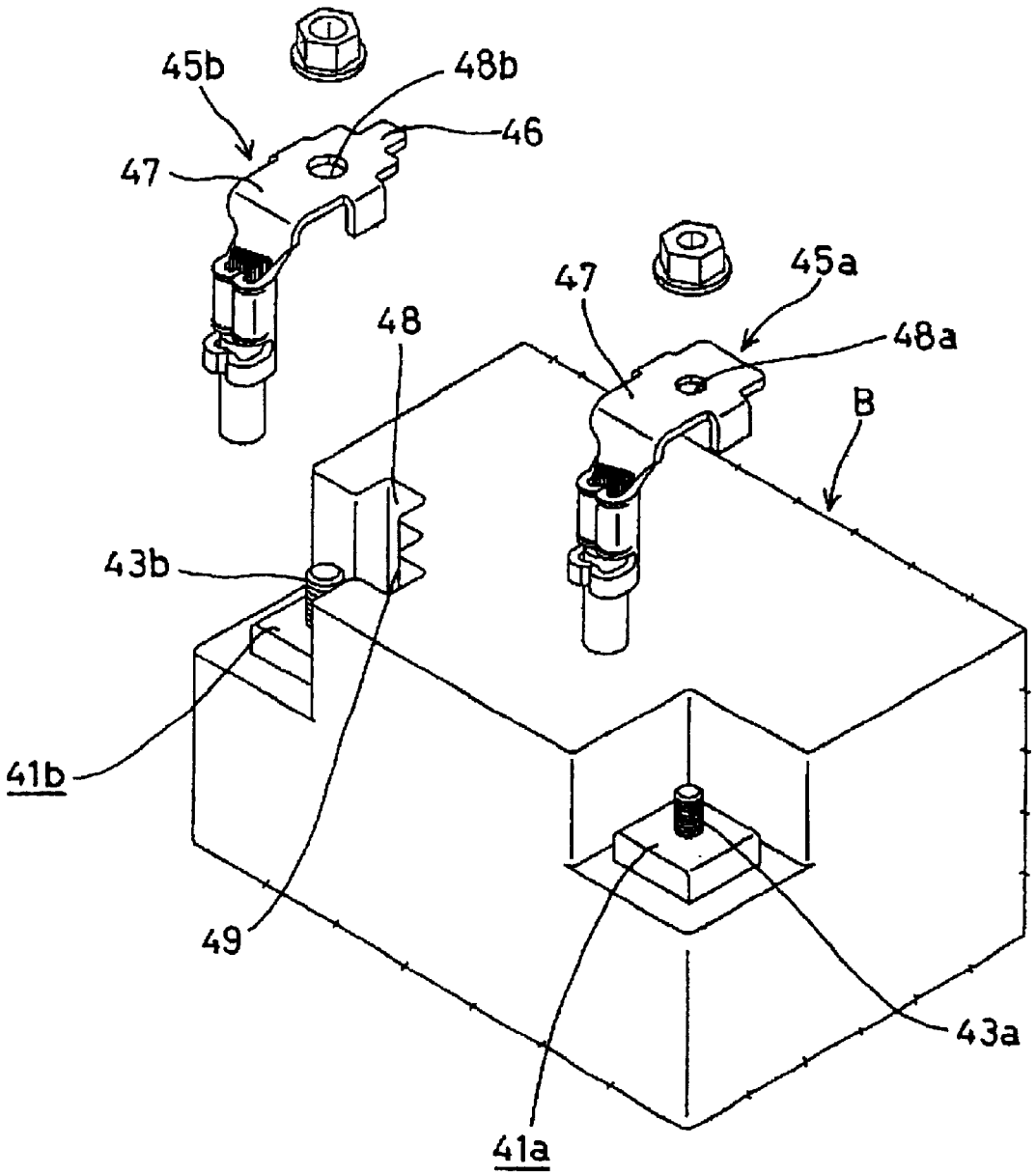
FIG. 6 is an exploded perspective view showing an assembling construction of a third embodiment.
Figure 7:
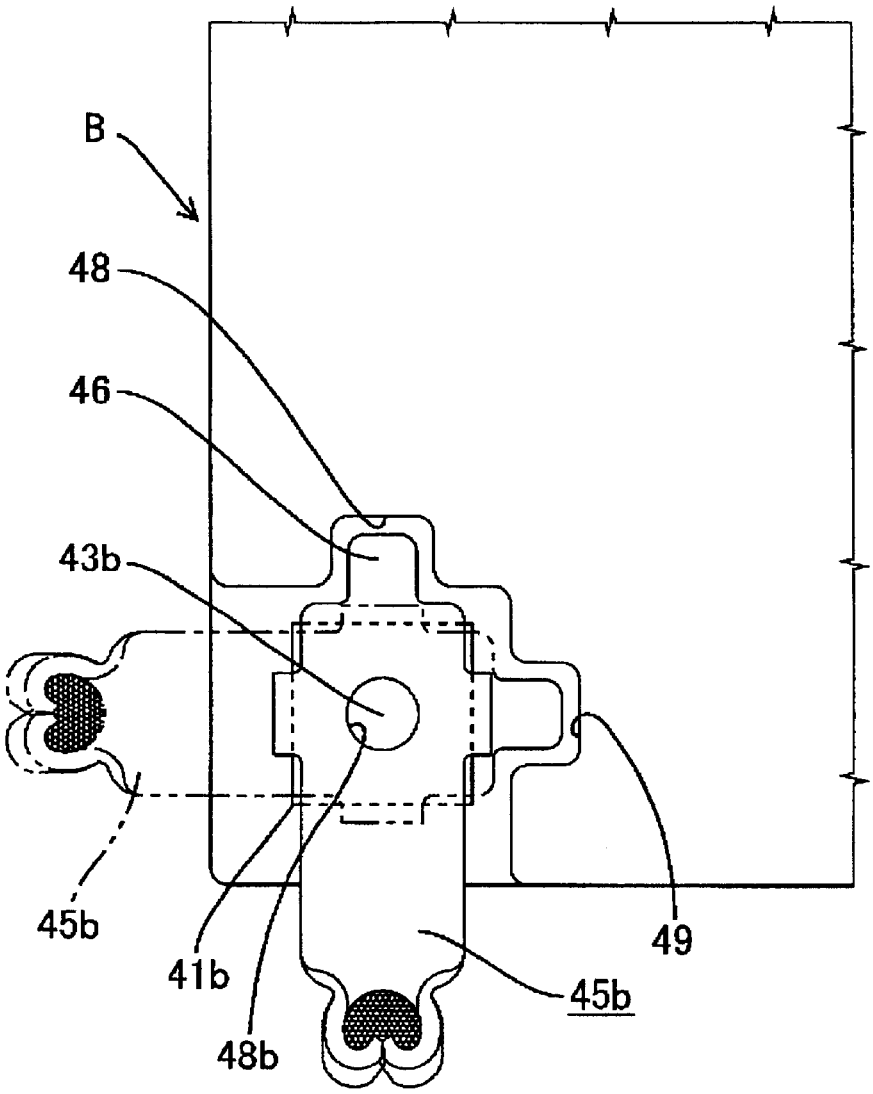
FIG. 7 is a plan view showing an assembled state of an engaging portion and a terminal.

FIGS. 6 and 7 show a third embodiment of the present invention. Electrodes 41*a*, 41*b* in this embodiment are provided respectively with smaller and larger diameter threaded shafts 43*a*, 43*b*. Engaging portions are recessed in a depth direction similar to the first two embodiments, and two side walls of the left engaging portion in FIG. 6 are recessed to form first and second identical key receiving portions 48 and 49.

Insertion holes 48*a*, 48*b* pierce the base plates 47 of the terminals 45*a*, 45*b* and are provided respectively with smaller and larger diameters in conformity with the diameters of the threaded shafts 43*a*, 43*b*. A key 46 projects from the leading edge of the base plate 47 of the terminal 45*b*, and is dimensioned to fit into the key receiving portions 48, 49. The key 46 will interfere with the upper surface of the battery B and prevent the terminal 45*b* from being fit on the electrode 41*a*.

The terminal 45*a* with the smaller insertion hole 48*a* can be connected with the corresponding electrode 41*a*, in either of two optional positions, and preferably a position that matches either of the optional assembled positions of the other terminal 45*b* shown in FIG. 7.

The smaller insertion hole 48*a* of the terminal 45*a* cannot receive the thicker threaded shaft 43*b* of the electrode 41*a*. The thinner threaded shaft 43*a* of the electrode 41*a* can be inserted through the larger insertion hole 48*b* of the terminal 45*b*. However, the key 46 of the terminal 45*a* interferes with the upper surface of the battery B near the electrode 41*a*. As a result, the terminal 45*b* cannot be fit into the engaging portion of the electrode 41*a*. Accordingly, the third embodiment avoids erroneous assembly of the terminals 45*a,* 45*b* and the electrodes 41*a,* 41*b.*

Figure 8:
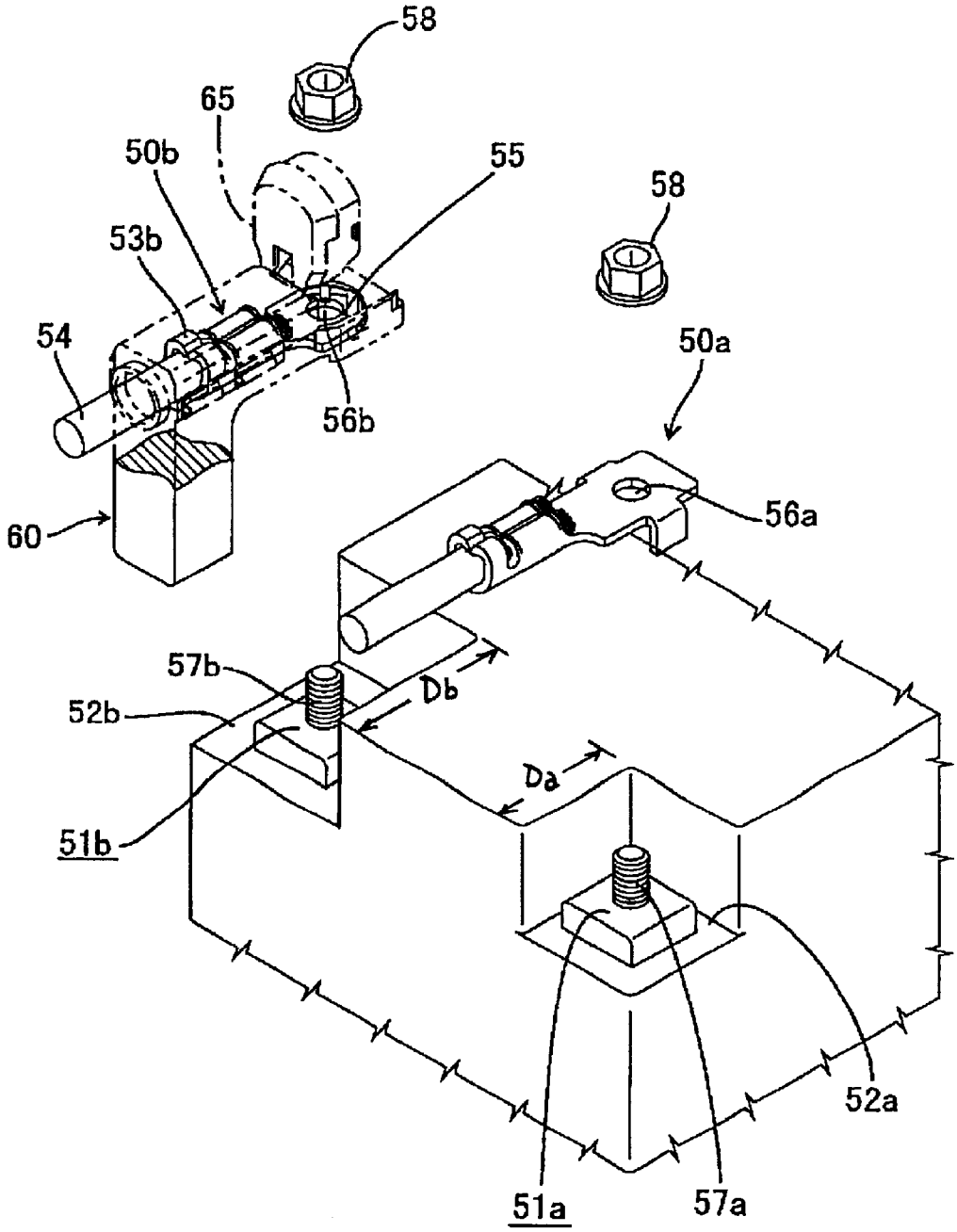
FIG. 8 is an exploded perspective view showing an assembling construction of a fourth embodiment.
Figure 9:
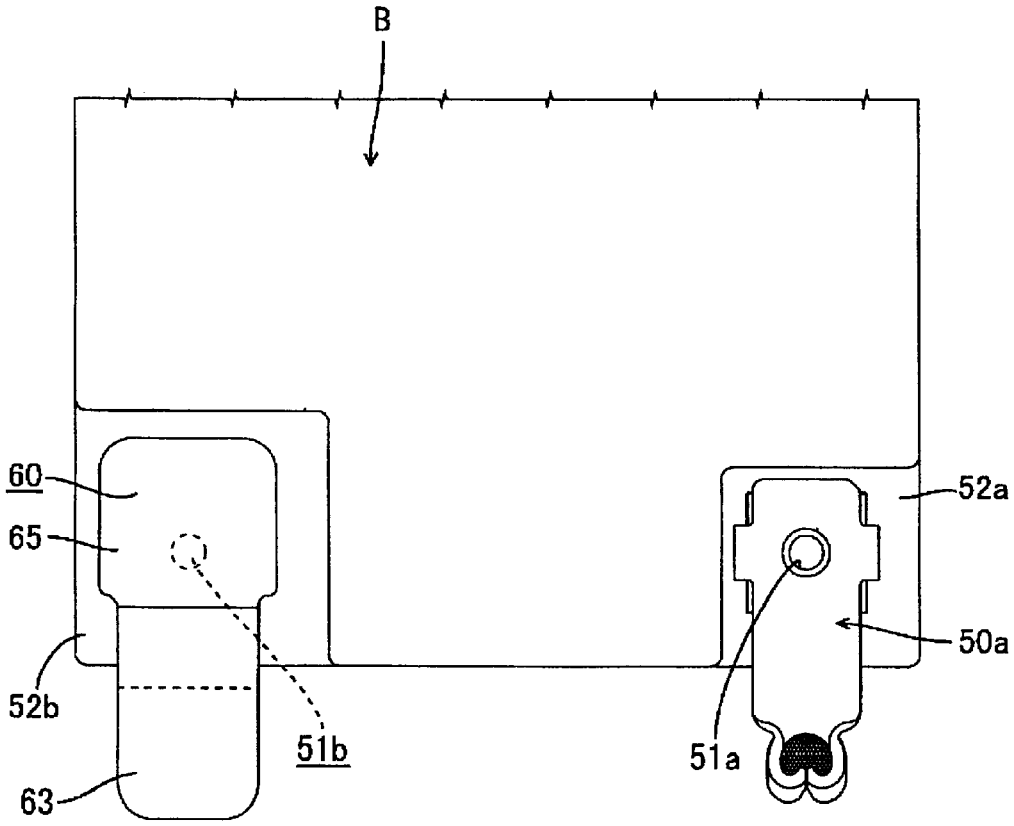
FIG. 9 is a plan view showing an assembled state of an engaging portion and a terminal.
Figure 10:
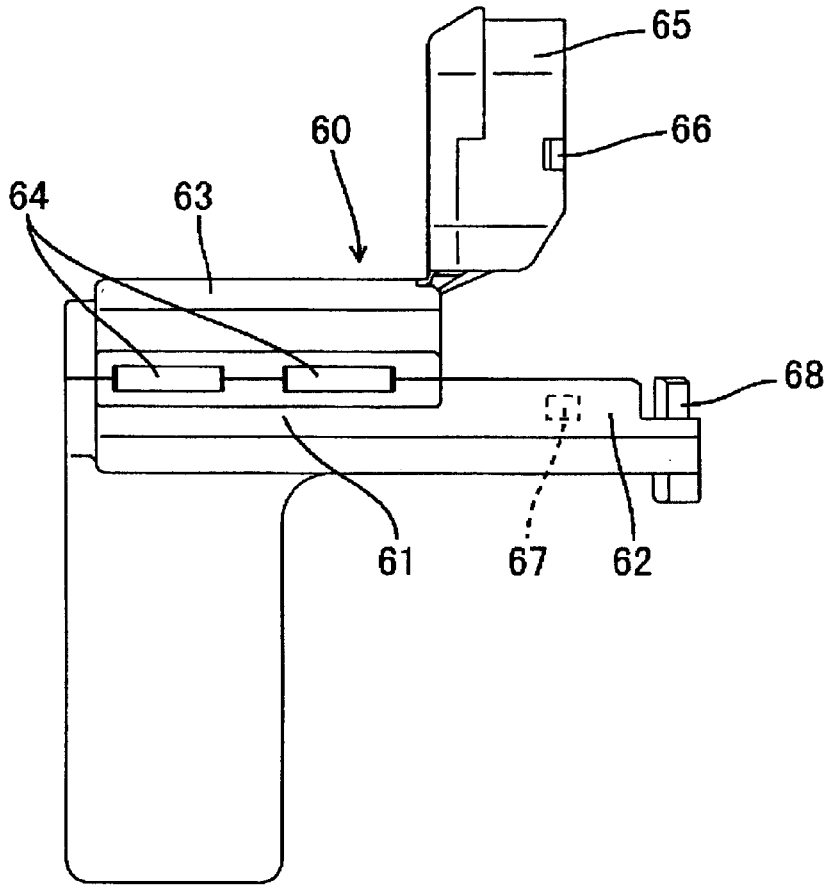
FIG. 10 is a side view of a cover with a second lid left open.
Figure 11:
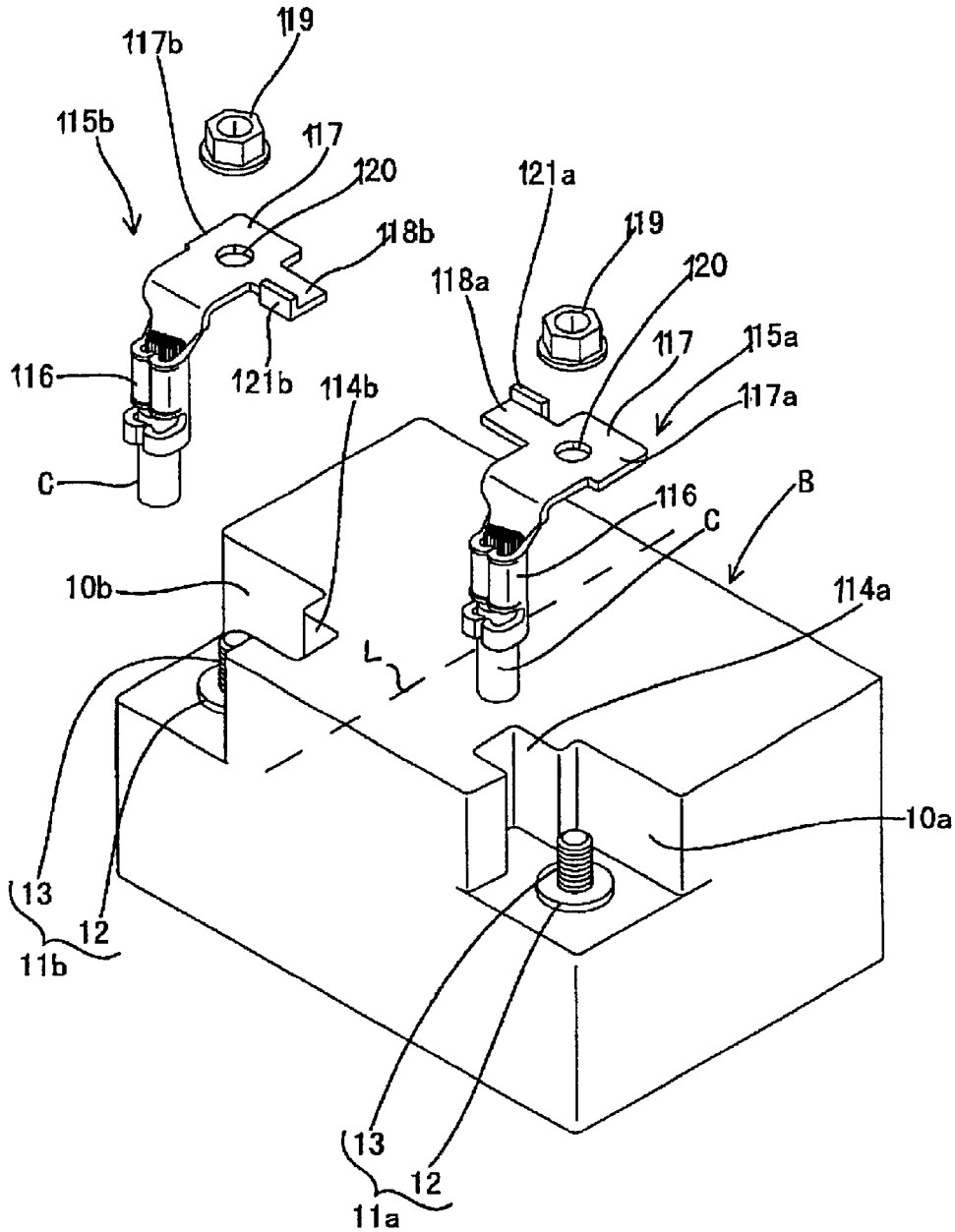
FIG. 11 is an exploded perspective view showing an assembling construction of a fifth embodiment.
Figure 12:
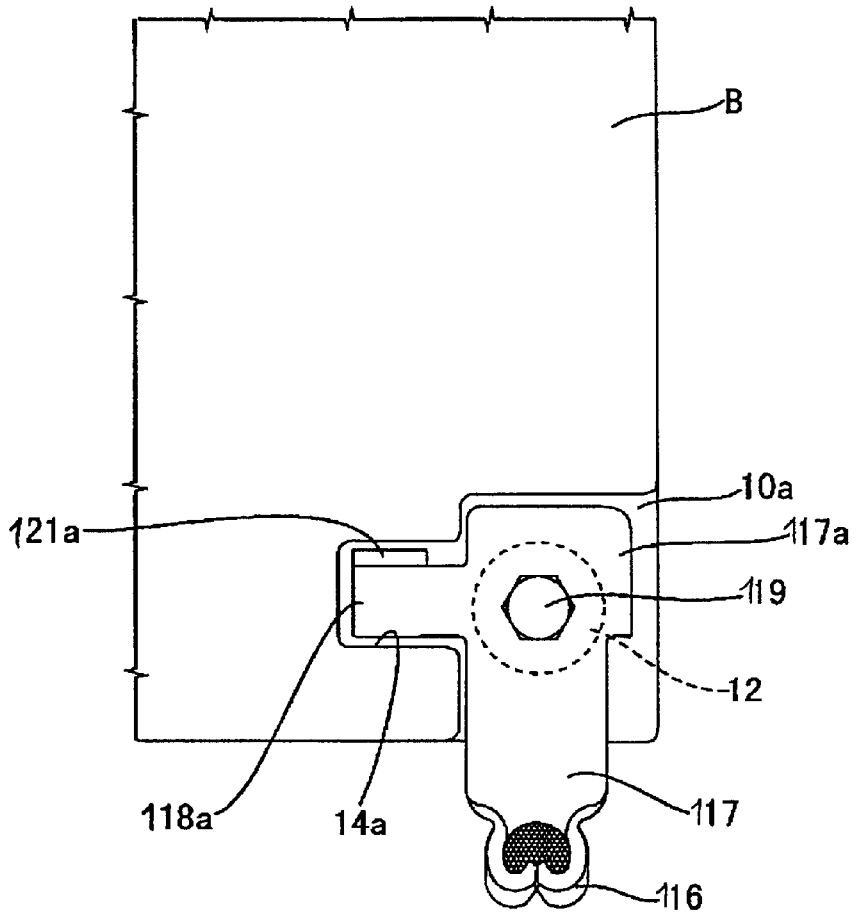
FIG. 12 is a plan view showing an assembled state of an engaging portion and a terminal.
Figure 13:
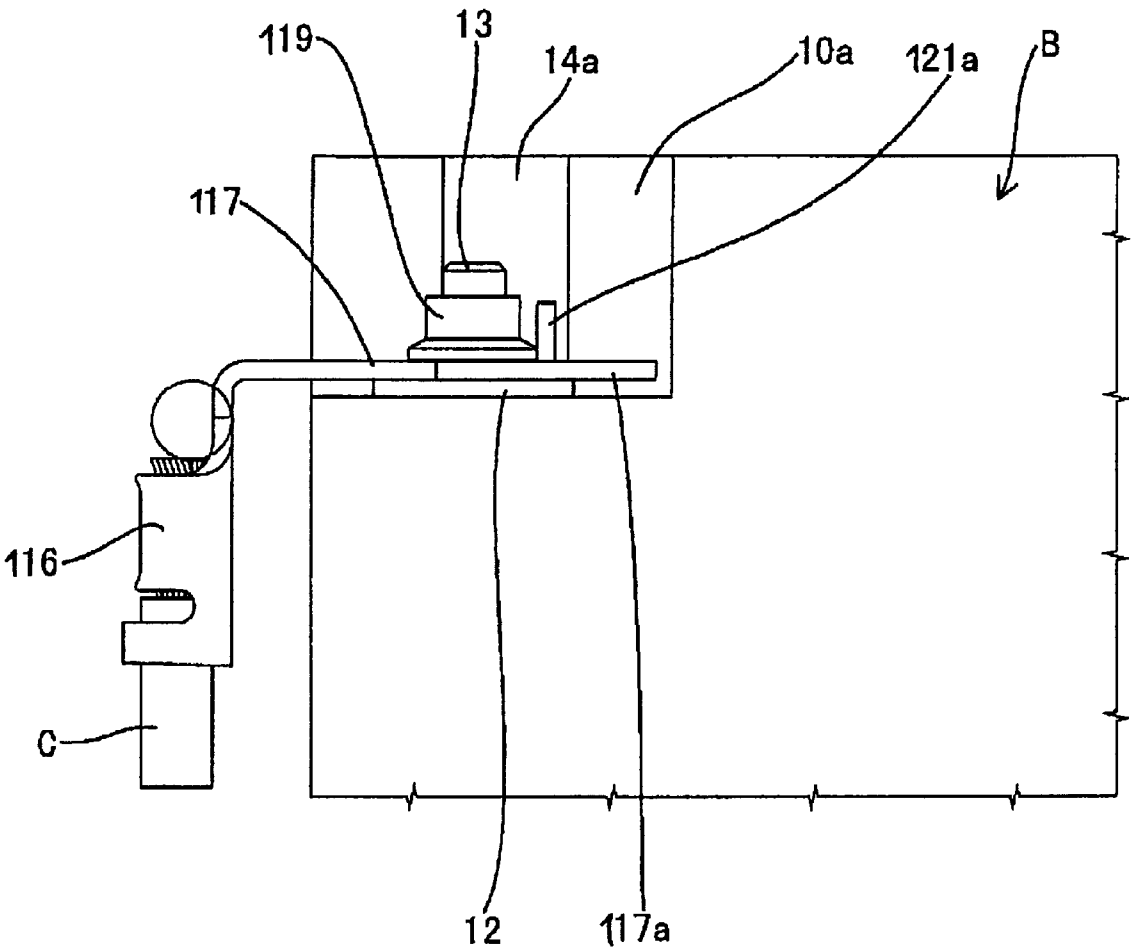
FIG. 13 is a side view showing the assembled state of the engaging portion and the terminal.

A fourth embodiment of the invention has a cover 60 placed over one terminal 50*b,* as shown in FIGS. 8–10, to differentiate the length of the terminal 50*b* from a terminal 50*a* that has no cover. Accordingly, the lengths Da, Db of terminal accommodating portions 52*a,* 52*b* formed around electrodes 51*a,* 51*b* are different. The different lengths Da, Db prevent the terminal 50*b* with the cover 60 from being fit into the terminal accommodating portion 52*a*. Specifically, the right terminal accommodating portion 52*a* around the electrode 51*a* in FIG. 8 is substantially square in plan view, whereas the left terminal accommodating portion 52*b* is an elongate rectangle.

The terminals 50*a* and 50*b* of FIGS. 8–10 are substantially the same as those of FIGS. 6 and 7. However, barrels preferably are formed straight without being bent in this embodiment.

The cover 60 is integrally or unitarily made of an insulating material and is mounted on the terminal 50*b* for the (+)-electrode 51*b* in FIG. 8. The cover 60 comprises a barrel portion 61 for accommodating both the barrel 53*b* of the terminal 50*b* and part of the battery cord 54, and a connector portion 62 for accommodating a connector 55 that connects with the electrode 51*b*. A first lid 63 is hinged to the barrel portion 61 of the cover 60, and pivots to open and close the connector portion 62. Two locking claws 64 are formed at an edge of the barrel portion 61 opposite the hinge and are locked into engagement with a base end of the barrel portion 61 when the first lid 63 is closed. A second lid 65 is hinged to the first lid 63 for opening and closing the connector 55 of the terminal 50*b*. Locking projections 66 on the first lid 65 engage corresponding locking recesses 67 to lock the second lid 65 and to cover substantially the entire surface of the connecting portion 55 of the terminal 50*b*. A stopper 68 projects at the leading end inside the connector portion 62, and can contact the leading end of the terminal 50*b* to position the terminal 50*b* being accommodated. The bottom wall of the connector portion 62 has an unillustrated through hole that is alignable with an insertion hole 56*b* of the terminal 50*b*. Thus a threaded shaft 57*b* of the electrode portion 51*b* can be inserted through the insertion hole 56*b* via this through hole.

The distance from the center of the insertion hole 56*b* of the terminal 50*b* to the front edge of the cover 60 is longer than the distance from the center of an insertion hole 56*a* to the front end of the terminal 50*a*. Thus, the terminal 50*b* and the cover 60 can be fit into the left terminal accommodating portion 52*b* shown in FIGS. 8 and 9 and connected with the electrode portion 51*b*. However, the terminal 50*b* cannot be fit into the smaller terminal accommodating portion 52*a* because the leading end of the cover 60 will interfere with the upper surface of the battery B. Thus, it is impossible to fit the terminal 50*b* into the terminal accommodating portion 52*a,* and an operator will notice the erroneous assembly.

Connection of the terminal 50*a* is completed by inserting the threaded shaft 57*a* at the right side of FIGS. 8 and 9 through the insertion hole 56*a* of the terminal 50*a* and screwing the nut 58 down on the threaded shaft 57*a*. The cover 60 then is mounted on the terminal 50*b* and the battery cord 54 with the second lid 65 of the cover 60 open. The threaded shaft 57*b* at the left side of FIGS. 8 and 9 then is inserted through the insertion hole 56*b* via the through hole and the nut 58 is screwed onto the threaded shaft 57*b*. The second lid 65 then is closed and the locking projections 66 engage with the locking recesses 67 to hold the second lid 65 closed.

The terminal 50*b* provided with the cover 60 cannot be fit into the right terminal accommodating portion 52*a* in FIGS. 8 and 9 because the leading end of the cover 60 interferes with the upper surface of the battery B due to the smaller dimensions of the right terminal accommodating portion 52*a*. Additionally, the threaded shaft 57*b* will not match the through hole if an attempt is made to fit the terminal 50*b* into the terminal accommodating portion 52*a* at an angle that might avoid interference of the cover 60 with the upper surface of the battery B. Therefore, erroneous assembling can be avoided in this embodiment.

The letter B in FIGS. 11–14 identifies a battery in accordance with a fifth embodiment of the invention. As in the previous embodiments, left and right corners of the battery B form recessed engaging portions 10*a,* 10*b*, which are provided respectively with a (+)-electrode 11*a* and a (–)-electrode 11*b*. The electrodes 10*a,* 10*b* have threaded shafts 13*a,* 13*b* that project substantially vertically through washers 12. The depth of the engaging portions 10*a,* 10*b* exceeds the height of the threaded shafts 13*a,* 13*b*, and hence the shafts 13*a,* 13*b* do not project to the upper surface of the battery B. Transversely symmetrical identification recesses 114*a*, 114*b* are formed in side walls of the respective engaging portions 10*a,* 10*b*, and extend inwardly toward each other. Thus, the identification recesses 114*a*, 114*b* are substantially symmetrical with respect to a transverse line L between the electrodes 11*a,* 11*b.*

Terminals 15*a*, 15*b* are connectable with the electrodes 11*a,* 11*b*. The terminals 15*a* and 15*b* are made of a conductive metal and each has a barrel 16 at its rear end for crimped connection to a battery cord C. Base plates 117 are formed at the fronts of the terminals 15*a*, 15*b* and are bent substantially at right angles to the barrels 16. The middle of each base plate 117 has an insertion hole 120 that is dimensioned to receive one of the threaded shafts 13*a,* 13*b*. The base plates 117 of the left and right terminals 15*a*, 15*b* are formed to be transversely symmetrical. Specifically, transversely symmetrical identification pieces 117*a,* 117*b* project from side edges of the base plates 117 of the respective terminals 15*a*, 15*b*. The width of each identification piece 117*a,* 117*b* exceeds the width of the identification recesses 114*a*, 114*b*. Thus, if an attempt is made to assemble the terminals 15*a*, 15*b* and the electrodes 11*a,* 11*b* in an incorrect correspondence, the identification pieces 117*a,* 117*b* and the identification recesses 114*a*, 114*b* interfere with each other as shown in FIG. 14, and prevent assembly of the terminals 15*a*, 15*b.*

Rotation preventing pieces 118*a,* 118*b* project from side edges of the base plates 117 opposite from the identification pieces 117*a,* 117*b*. The rotation preventing pieces 118*a,* 118*b* are narrower than the identification pieces 117*a,* 117*b* and can be fit into the identification recesses 114*a*, 114*b* when the terminals 15*a,* 15*b* and the electrodes 11*a,* 11*b* correspond correctly. Thus, the terminals 15*a*, 15*b* will not rotate as the nuts 119 are tightened onto the threaded shafts 13. Contact pieces 121*a,* 121*b* are bent upward along side edges of the rotation preventing pieces 118*a,* 118*b* that are forward with respect to the rotating directions of the nuts 119. The contact pieces 121*a,* 121*b* enlarge contact areas with the identification recesses 114*a*, 114*b* and prevent damage to the battery B.

The rotation preventing pieces 118*a,* 118*b* of the terminals 15*a*, 15*b* fit into the corresponding identification recesses 114*a*, 114*b* if there is correct correspondence between the terminals 15*a*, 15*b* and the electrodes 11*a,* 11*b*. The threaded shafts 13 then are inserted into the insertion holes 120 and the base plates 117 are placed on the washer rings 12, such that the barrels 16 of the terminals 15*a*, 15*b* and the battery cords C extend substantially along side surfaces of the battery B. Connections of the terminals 15*a*, 15*b* are completed by screwing the nuts 119 onto the threaded shafts 13. The terminals 15*a*, 15*b* try to rotate clockwise at a final stage of fastening. However, the contact pieces 121*a*, 121*b* of the rotation preventing pieces 118*a*, 118*b* contact the facing surfaces of the identification recesses 114*a*, 114*b* to prevent rotation. Thus, fastening with the nuts 119 can be performed smoothly.

Figure 14:
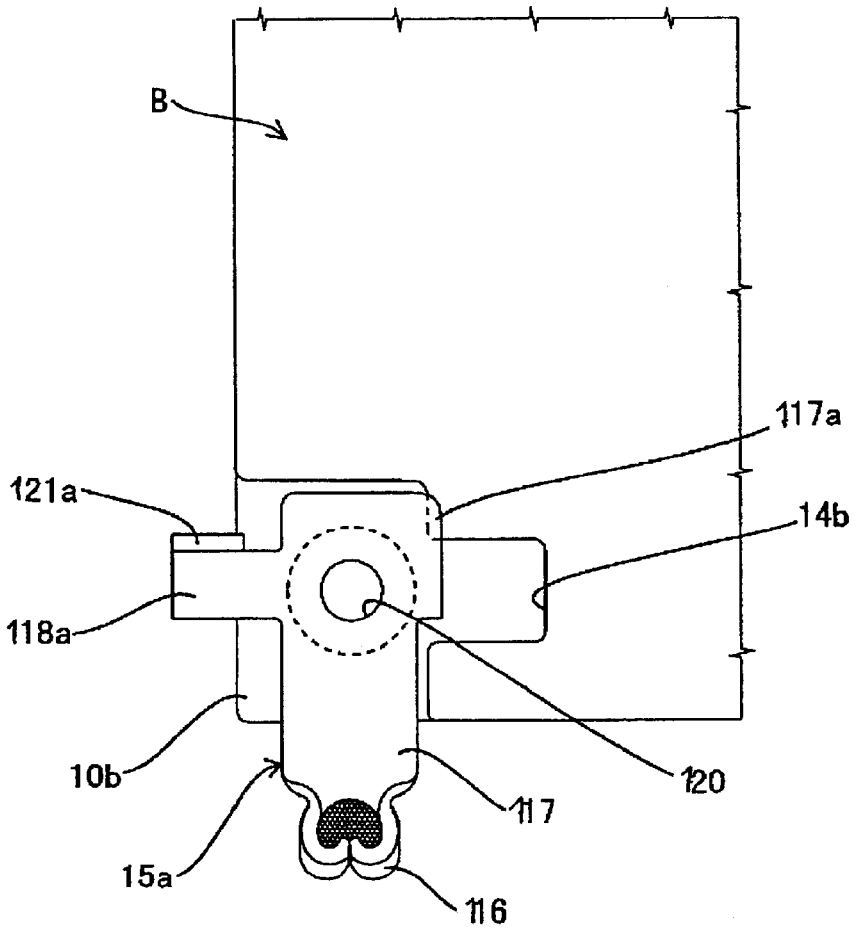
FIG. 14 is a plan view showing a case of erroneous assembling.

An incorrect correspondence between the terminals 15*a*, 15*b* and the electrodes 11*a*, 11*b* will cause the identification pieces 117*a*, 117*b* to interfere with the opening edges of the identification recesses 114*a*, 114*b*, as shown in FIG. 14. As a result, the terminals 15*a*, 15*b* cannot fit into the engaging portions 10*a*, 10*b*. An operator will notice this incorrect correspondence between the terminals 15*a*, 15*b* and the electrodes 11*a*, 11*b*.

Correct or incorrect correspondence between the terminals 15*a*, 15*b* and the electrodes 11*a*, 11*b* can be determined based on whether the identification pieces 117*a*, 117*b* interfere with the upper surface of the battery B. Further, the rotating preventing pieces 118*a*, 118*b* engage the identification recesses 114*a*, 114*b* to prevent rotation of the terminals during fastening with the nuts 119. Thus, fastening can be performed smoothly and easily. Furthermore, the contact pieces 121*a*, 121*b* enlarge the contact areas with the walls of the identification recesses 114*a*, 114*b*. Thus the rotation preventing pieces 117*a*, 117*b* will not bite in the walls of the identification recesses 114*a*, 114*b*, thereby protecting the battery B from damage or scratches.

The battery B of this embodiment has a special form in which the engaging portions 10*a*, 10*b* are formed around the electrodes 11*a*, 11*b*, to distinguish the battery B from conventional 12V-batteries. Furthermore, the depth of the engaging portions 10*a*, 10*b* is set such that the threaded shafts 13*a*, 13*b* do not project to the upper surface of the battery B. Thus, inadvertent contact of a tool or the like with the threaded shafts 113 is avoided.

Figure 15:
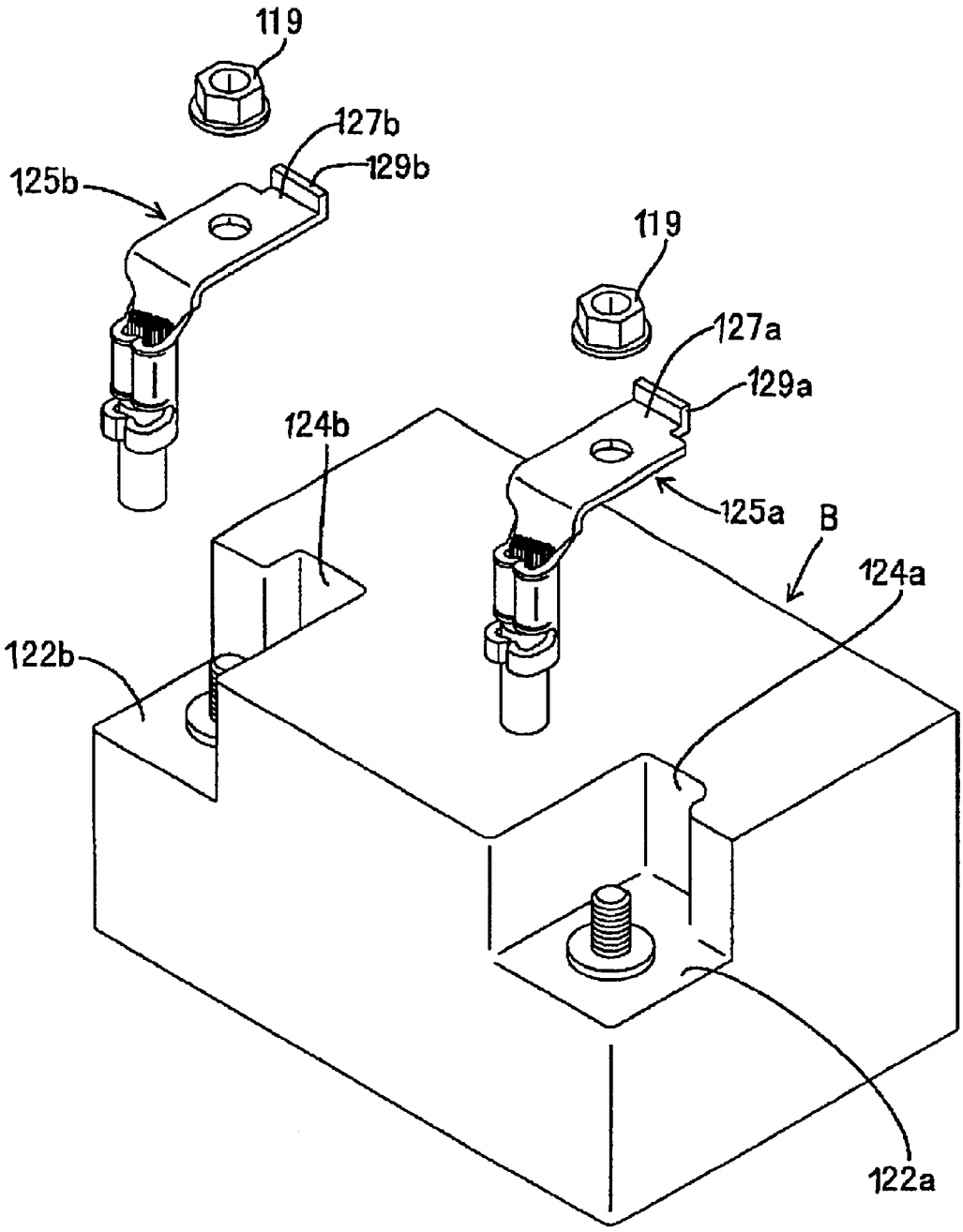
FIG. 15 is an exploded perspective view showing an assembling construction of a sixth embodiment.
Figure 16:
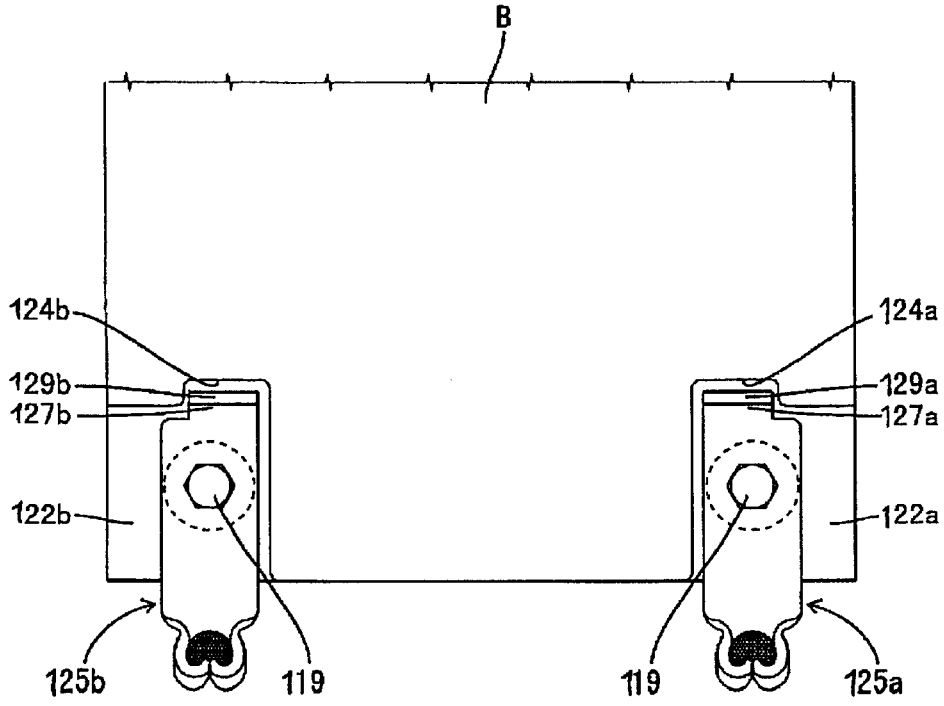
FIG. 16 is a plan view showing an assembled state of an engaging portion and a terminal.
Figure 17:
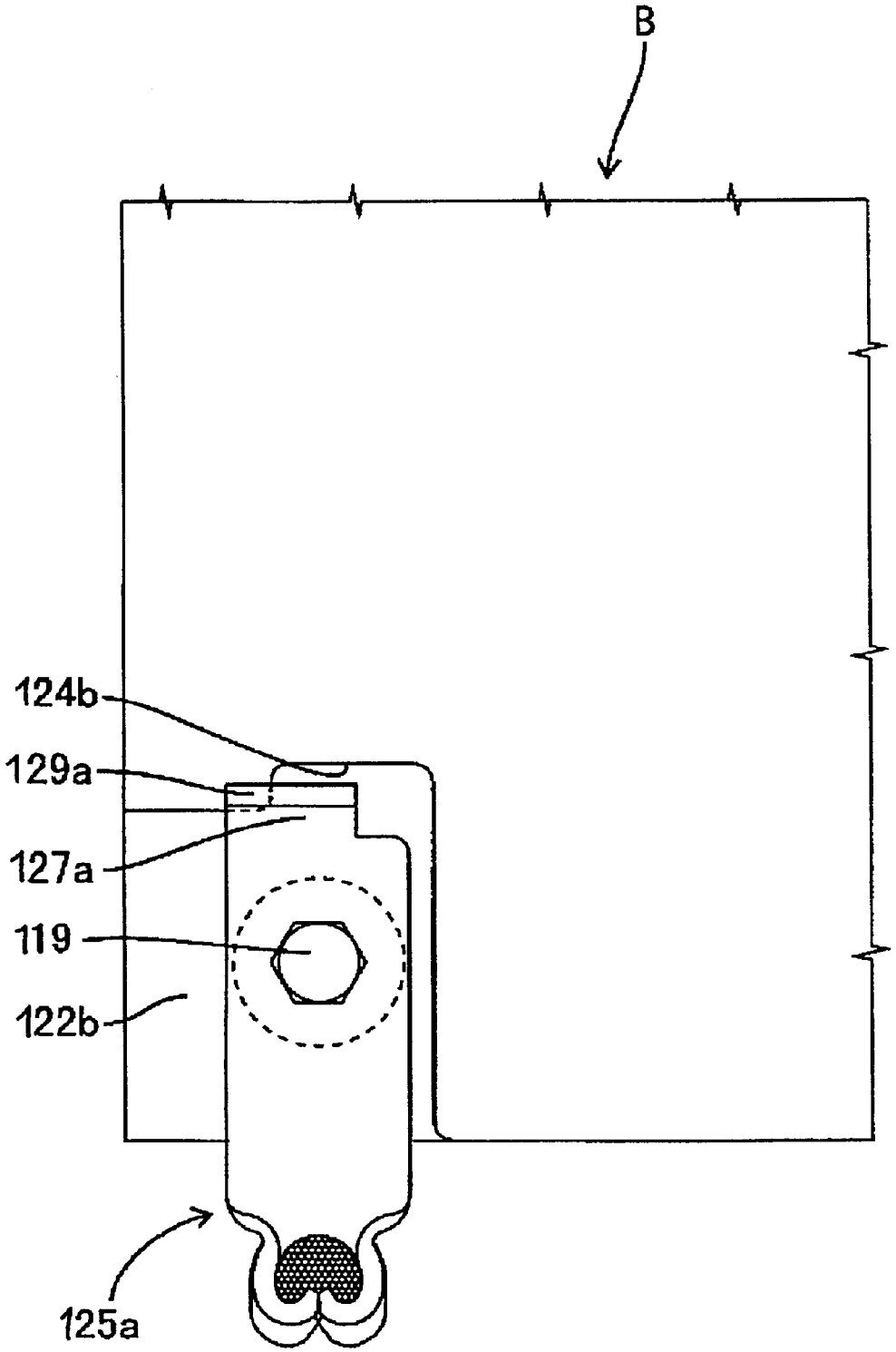
FIG. 17 is a plan view showing a case of erroneous assembling.

A sixth embodiment of the invention is shown in FIGS. 15–17 and has terminals 125*a*, 125*b* with identification pieces 127*a*, 127*b* that project from the leading edges of the terminals 125*a*, 125*b* in a longitudinal direction. The terminals 125*a*, 125*b* are transversely symmetrical, and each identification piece 127*a*, 127*b* is displaced toward one side edge of a base plate. Leading ends of the identification pieces 127*a*, 127*b* are bent upward to form contact pieces 129*a*, 129*b*. The contact pieces 121*a*, 121*b* were brought substantially into surface contact with the walls of the identification recesses 14*a*, 14*b* in the fifth embodiment. However, side edges of the contact pieces 129*a*, 129*b* are brought into contact with the walls of identification recesses 124*a*, 124*b* to prevent the rotation of the terminals 125*a*, 125*b* in the sixth embodiment.

Specifically, the identification recesses 124*a*, 124*b* are formed in the back or lateral walls of engaging portions 122*a*, 122*b* in positions substantially corresponding to the identification pieces 127*a*, 127*b* of the correctly arranged terminals 125*a*, 125*b*. Thus, the engaging portions 122*a*, 122*b* are transversely symmetrical. Other construction of the sixth embodiment is the same as or similar to the fifth embodiment.

The terminals 125*a*, 125*b* of the sixth embodiment cannot be connected with the incorrect electrodes 123*a*, 123*b* because the identification pieces 127*a*, 127*b* will not match the identification recesses 124*a*, 124*b* and will interfere with the peripheries of the identification recesses 124*a*, 124*b*. Rotation of the terminals 125*a*, 125*b* during fastening of the nuts 119 can be prevented by contact between the side edges of the contact pieces 129*a*, 129*b* and the walls of the identification recesses 124*a*, 124*b* during fastening of the nuts 119. Further, the constructions of the terminals and the battery can be simplified since the identification pieces 127*a*, 127*b* also act as rotation preventing pieces.

Figure 18:
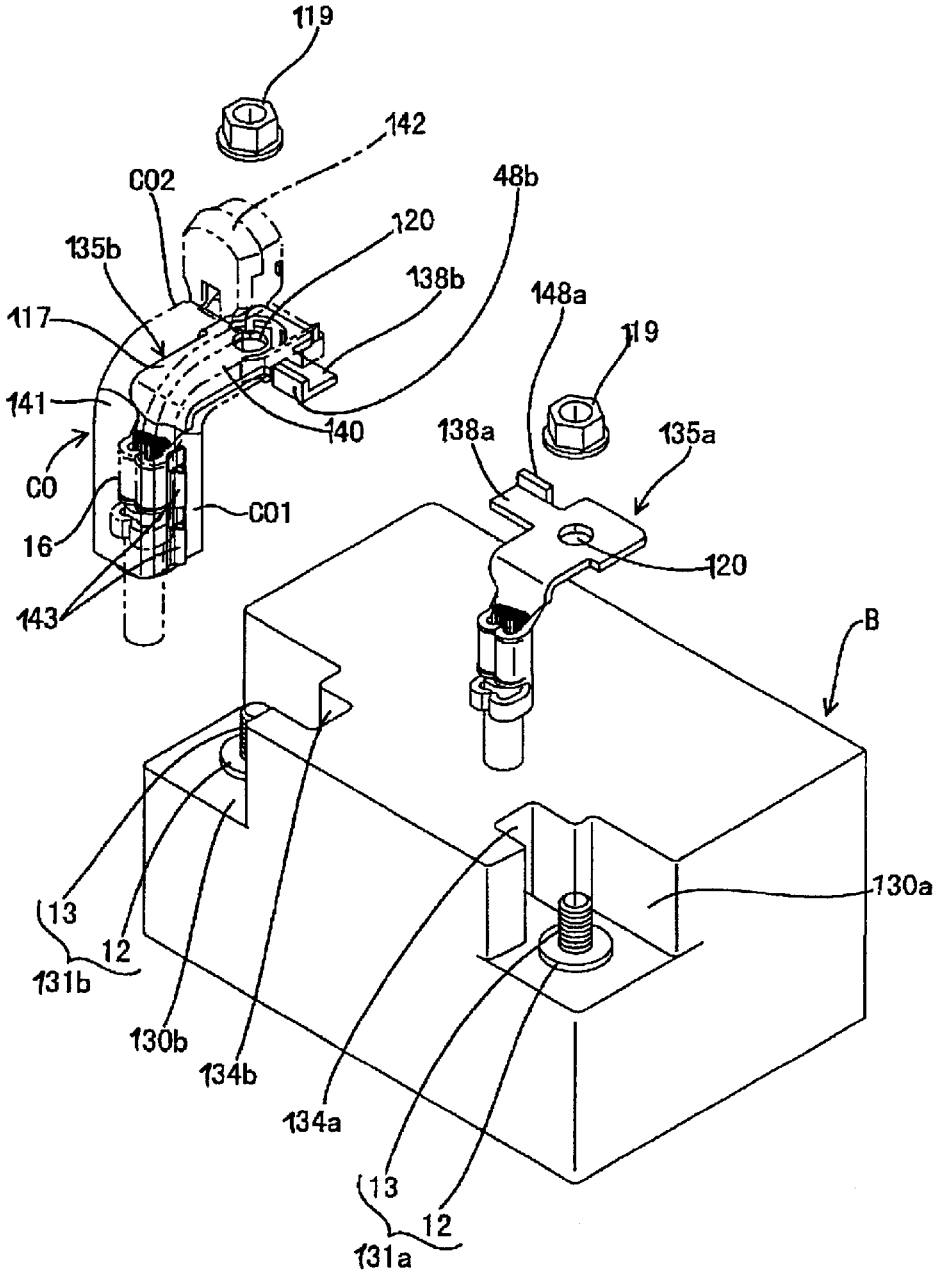
FIG. 18 is an exploded perspective view showing an assembling construction of a seventh embodiment.
Figure 19:
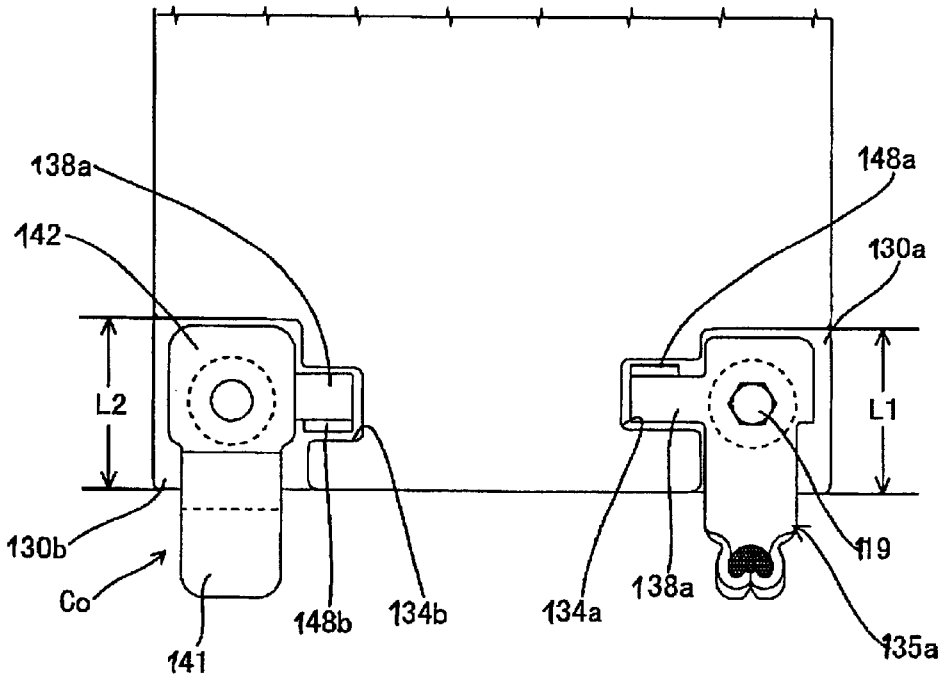
FIG. 19 is a plan view showing an assembled state of an engaging portion and a terminal.
Figure 20:
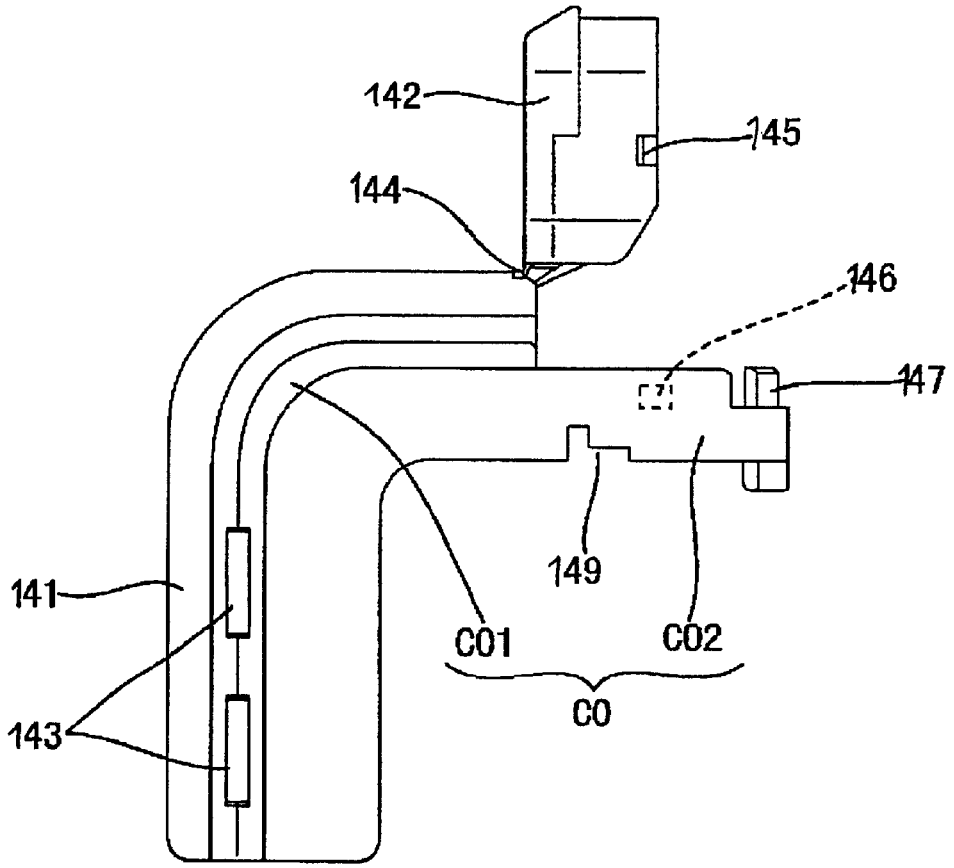
FIG. 20 is a side view of a cover with a second lid left open.

FIGS. 18 to 20 show a seventh embodiment of the invention. In the seventh embodiment, a cover CO is fit on or over one terminal 135*b* to differentiate the lengths of portions of the terminals to be accommodated in engaging portions 130*a*, 130*b*. More particularly, lengths of the engaging portions 130*a*, 130*b* differ (L1<L2), so that the terminal 135*b* provided with the cover CO cannot be fit into the engaging portion 130*a* in the case of an incorrect correspondence between the terminals 135*a*, 135*b* and electrode portions 131*a*, 131*b*.

The cover CO preferably is made integrally or unitarily of a synthetic resin and has a barrel portion CO1 for accommodating a barrel 16 of the terminal 135*b* and a part of a battery cord C. The cover CO also has a connecting portion CO2 that is continuous with and bent from the barrel portion CO1 and is adapted to accommodate a connector 140 for connection with the electrode 131*b*. The cover CO has a first lid 141 which is pivotal to open and close about a hinge at one edge extending from the barrel portion CO1 to the connecting portion CO2. Two locking claws 143 are formed at an edge of the barrel portion CO1 substantially opposite from the hinged edge and can be locked into engagement with a base end when the first lid 141 is closed.

The connecting portion CO2 has a second lid 142 for opening and closing the connector 140 of the terminal 135*b*. The second lid 142 is pivotal about a hinge 144 at a boundary with the first lid 141. Locking projections 145 are formed on the first lid 142 for engagement with corresponding locking recesses 146 to substantially close the second lid 142, thereby substantially covering the entire surface of the connector 140 of the terminal 135*b*.

A stopper 147 projects at the leading end inside the connecting portion CO2 and contacts the leading end of the terminal 135*b* to position the terminal 135*b* being accommodated. The bottom wall of the connecting portion CO2 has an unillustrated through hole that aligns with an insertion hole of the terminal 135*b*, so that a threaded shaft 13 of the electrode portion 31*b* can be inserted through the insertion hole 120 via the through hole. As shown in FIG. 20, an escape hole 149 is formed in the bottom end of a side wall at a base of the connecting portion CO2 for drawing a rotation preventing piece 138*b* and a contact piece 148*b* of the terminal 135*b* out of the cover CO.

The terminal 135*a* can be connected as described above to the (−)-electrode at the right side in FIG. 18. The terminal 135*b*, on the other hand, can be accommodated in the cover CO with the first and second lids 141, 142 left open. The first lid 141 then can be closed and locked by the locking claws 143. At this stage, the rotation preventing piece 138*b* of the terminal 135*b* projects out of the cover CO through the escape hole 149. The threaded shaft 13 then is inserted through the insertion hole 120 via the unillustrated through hole in the bottom wall of the cover CO. The rotation preventing piece 138*b* then is fit into the identification recess 134*b*. Thereafter, the nut 119 can be screwed smoothly because rotation of the terminal is prevented by engagement of the contact piece 148*b* of the rotation preventing piece 138*b* with the wall. The second lid 142 then is closed to engage the locking projections 145 with the corresponding locking recesses 146, and the second lid 146 is held closed.

The terminal 135*b* provided with the cover CO cannot be fitted into the engaging portion 130*a*. More particularly, even if an attempt is made to adjust the position of the unillustrated through hole to match the position of the threaded shaft, the leading end of the cover CO interferes with the upper surface of the battery B due to an insufficient length of the engaging portion 130*a* at the side of the (−)-electrode. Therefore, erroneous assembling can be avoided with the seventh embodiment. Deformation of the cover CO can be prevented since a fastening torque of the nut 19 is received by the rotation preventing piece 138*b* drawn out of the cover CO in the seventh embodiment.

Various changes can be made in the present invention, and following embodiments are also embraced by the technical scope of the present invention as defined in the claims.

Although the identification means or rotation preventing means are formed both in the battery and in the terminals (including the cover CO) and are constructed by engagement of the recess and projection in any of the foregoing embodiments, these relationships are merely relative and not limited to those of the foregoing embodiments.

The identification recesses are not limited to those formed in the side walls of the engaging portions, and may be formed in the bottom surfaces thereof.

What is claimed is:

1. A construction for preventing erroneous assembling of two battery terminals and to correctly assemble the terminals with a corresponding (−)-electrode and (+)-electrode of a battery, wherein the terminals and the electrodes comprise identification means for enabling assembling only in the case of a correct correspondence of the terminals and the electrodes while preventing assembly the terminals with the electrodes in the case of an incorrect correspondence, wherein the identification means of the electrodes comprises a threaded shaft on a first of the electrodes and a nut on a second of the electrodes, and the identification means of the terminal comprise a nut in the terminal corresponding to the first electrode having the threaded shaft, such that the nut can be screwed on the threaded shaft, and a threaded shaft on the terminal corresponding to the second electrode having the nut, the threaded shaft being engageable with the nut of the second electrode.

2. A construction for preventing erroneous assembly of two battery terminals and to correctly assemble the terminals with a corresponding (−)-electrode and (+)-electrode of a battery, wherein the terminals and the electrodes comprise identification means for enabling assembling only in the case of a correct correspondence of the terminals and the electrodes while preventing assembly the terminals with the electrodes in the case of an incorrect correpondence, wherein the identification means of the electrodes comprises a pair of threaded shafts having larger and smaller diameters respectively and a key receiving portion formed near the electrode having the larger threaded shaft, and the identification means of the terminals comprises insertion holes having larger and smaller diameters for enabling insertion of the threaded shafts and a key which is formed on the terminal having the larger insertion hole, the key being dimensioned to fit into the key receiving portion and preventing assembly of the terminal having the larger insertion hole with the electrode by interfering with a part of the battery if this terminal is connected with the electrode portion not corresponding thereto.

3. A construction for preventing erroneous assembly of two battery terminals and to correctly assemble the terminals with a corresponding (−)-electrode and (+)-electrode of a battery, the electrodes each comprising a threaded shaft, and the terminals being fastened to the threaded shafts by nuts, the terminals and the electrodes comprising identification means for enabling assembling only in the case of a correct correspondence of the terminals and the electrodes while preventing assembly the terminal with the electrodes in the case of an incorrect correspondence, the identification means comprising identification pieces symmetrically formed on both terminals and contact pieces formed by bending edges of the identification pieces, the contact pieces being located forward with respect to rotating directions of the terminals during fastening with the nuts, identification recesses being formed near the electrodes in the battery and in which the identification pieces can be fit, wherein, in the case of correct correspondence between the terminals and the electrodes, the identification pieces fit into the identification recesses and prevent rotation of the terminals by contact of the contact pieces with walls of the identification recesses during fastening with the nuts.

4. A construction according to claim 3, wherein a cover made of a synthetic resin is mounted on the terminal, and the identification piece of the terminal projects out of the cover.

* * * * *